United States Patent [19]

Pearlman

[11] 4,164,230

[45] Aug. 14, 1979

[54] AUTOMATIC SMOKING DEVICE

[76] Inventor: Walter Pearlman, 4 Eliot St., Somerville, Mass. 02143

[21] Appl. No.: 815,223

[22] Filed: Jul. 13, 1977

[51] Int. Cl.[2] ..... A24F 1/10; A24F 47/00

[52] U.S. Cl. ..... 131/171 R

[58] Field of Search ..... 131/171 R, 172, 231, 131/185, 186, 187, 195, 226, 222, 224

[56] References Cited

U.S. PATENT DOCUMENTS

| | | | |
|---|---|---|---|
| 402,681 | 5/1889 | Lindeman | 131/171 R |
| 2,105,904 | 1/1938 | Dale | 131/172 |
| 2,710,009 | 6/1955 | Blumberg | 131/172 |
| 2,788,085 | 4/1957 | Waller | 131/231 X |

FOREIGN PATENT DOCUMENTS

| | | | |
|---|---|---|---|
| 1518079 | 2/1968 | France | 131/171 |

*Primary Examiner*—Stephen C. Pellegrino
*Attorney, Agent, or Firm*—Charles Hieken

[57] ABSTRACT

An automatic smoking device includes a beverage can having a smoking bowl seated in the top centered above a platform beneath a fan chamber carrying a flat rotating fan blade about 1¼" long by ½" high facing a stem at the same height that fits in an opening in the can wall and is an alligator clip insulating boot. The platform separates the flat rotating fan blade above from an electric motor below whose shaft carries the flat rotating fan blade. The compartment below the platform also encloses a battery for powering the motor and a push-button switch for coupling current from the battery to the motor when the switch is pushed to rotate the fan blade.

8 Claims, 2 Drawing Figures

AUTOMATIC SMOKING DEVICE

BACKGROUND OF THE INVENTION

The present invention relates in general to automatic smoking and more particularly concerns novel apparatus and techniques for providing an economical automatic smoking device that is convenient to handle and operate and ejects a dense puff of smoke through the stem when an operating switch is actuated.

A prior art automatic smoking device was formed by a 35 millimeter film cartridge beneath the top of a beverage can substantially coextensive with a bowl above and having a flat fan blade inside the cartridge higher than it was wide with the stem coupled to the cartridge through an opening in the wall. An electric motor below drove the rotating fan blade. Apart from the difficulty of manufacturing, this prior art device did not perform as well as desired in terms of drawing and ejecting a dense stream of smoke through the stem, a difficulty encountered with a commercially available automatic smoking device employing a substantially square rotating fan blade inside rectangular plexiglass cubes.

A search of the prior art uncovered the following patents: British Pat. No. 606,991, French Pat. Nos. 1,500,907, 1,518,079, 3,695,275, 3,918,464.

It is an important object of this invention to provide an improved automatic smoking device.

It is another object of the invention to achieve the preceding object with an economical structure that is easy to hold and operate.

It is a further object of the invention to achieve one or more of the preceding objects while providing good draw on the pipe bowl, cooling the smoke and ejecting a dense stream of smoke through the stem when the smoker actuates the on switch.

It is a further object of the invention to achieve one or more of the preceding objects in a relatively safe manner.

SUMMARY OF THE INVENTION

According to the invention, there is a substantially circularly cylindrical hollow container divided by an internal circular plate into an upper or fan chamber and a lower or electrical chamber. Bowl means for accommodating smoking material, such as tobacco, is centered above the fan chamber and communicates through an axial opening with the fan chamber. The platform carries a depending electrical motor having its shaft extending upward through the platform along the chamber axis into the fan chamber for supporting a flat rotating fan blade that is longer than wide. Pipe stem means for carrying smoke from the fan chamber to a smoker extends through an opening in the fan chamber along the stem means axis that corresponds substantially with a diameter of the chamber at substantially the same height as the flat rotating fan blade. The electrical chamber also accommodates a battery and means for selectively coupling electrical energy from the battery to the electrical motor to rotate the fan blade, draw smoke from the bowl into the fan chamber and eject the smoke through the stem in a dense stream. The means for selectively coupling preferably comprises a push-button switch seated in a wall of the electrical chamber below the stem so that a smoker may conveniently grasp the lower portion of the chamber with thumb on switch and stem in mouth, push the switch and receive a dense puff of smoke.

Numerous other features, objects and advantages of the invention will become apparent from the following specification when read in connection with the accompanying drawing in which:

DETAILED DESCRIPTION OF PREFERRED EMBODIMENTS

Figure 2:
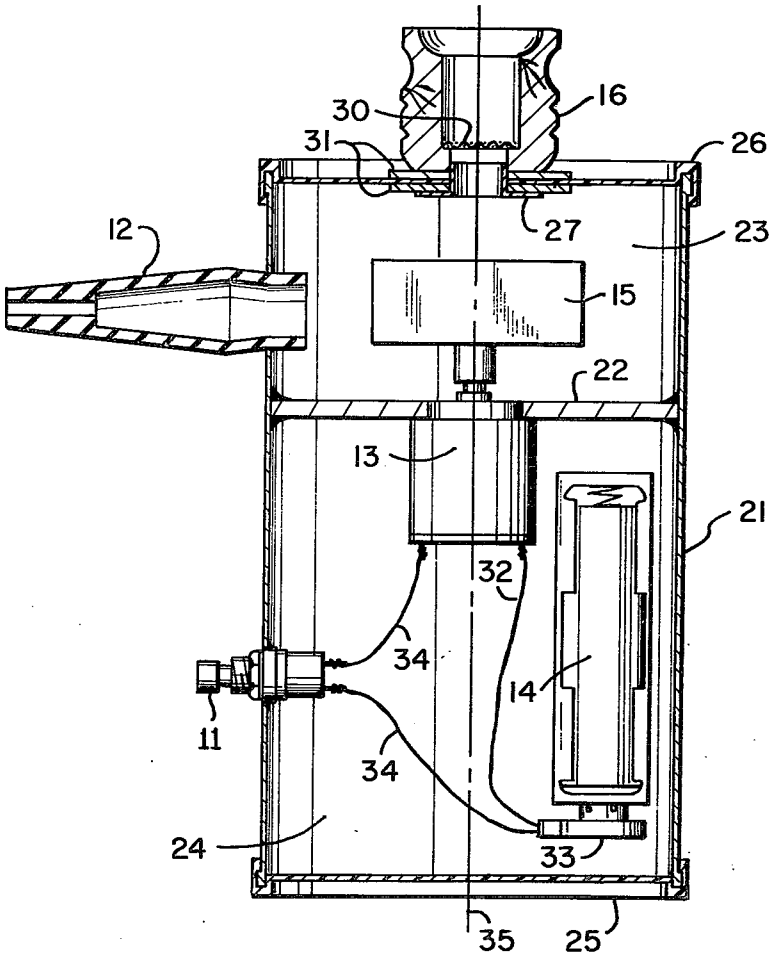
FIG. 2 is an axial sectional view along section 2—2 of FIG. 1.
Figure 1:
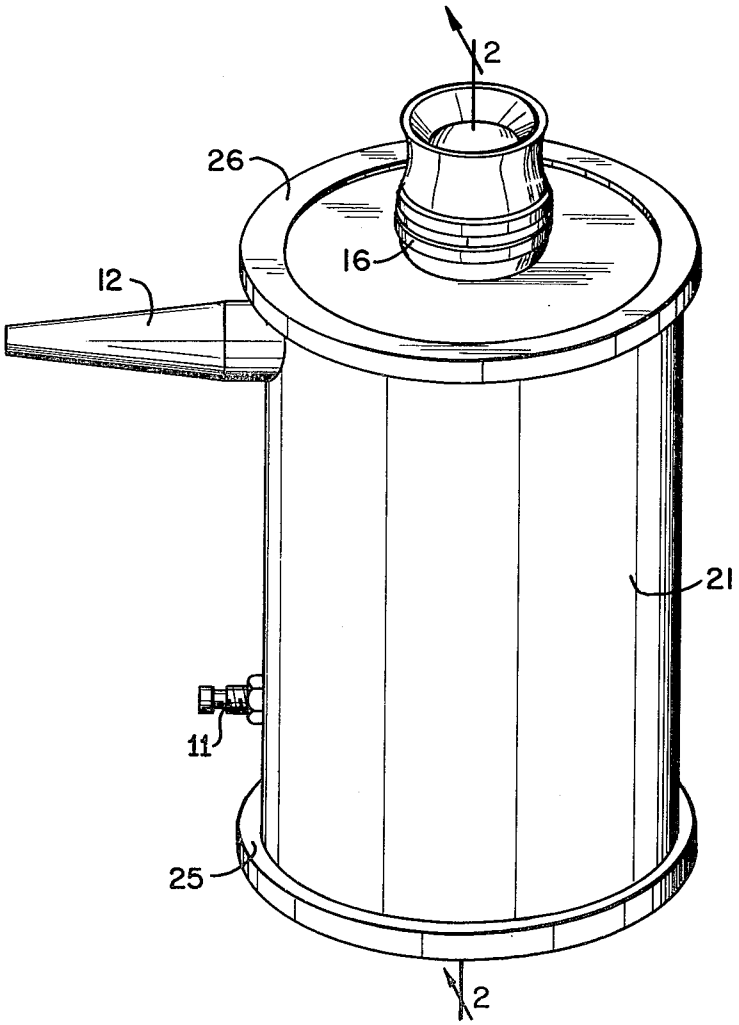
FIG. 1 is a perspective view of a preferred embodiment of the invention.

With reference now to the drawing, there is shown in FIG. 1 a perspective view and in FIG. 2 an axial sectional view along section 2—2 of FIG. 1 of an exemplary embodiment of the invention. A smoker may push push-button switch 11 to receive a dense puff of smoke through stem 12 as electrical motor 13 receives current from battery 14 to rotate flat rotating fan blade 15 and draw smoke from smoking material, such as tobacco, in bowl 16.

The automatic smoking device comprises a generally circularly cylindrical hollow-container 21, such as formed by an ordinary metal beverage can, divided by a pressed wood platform 22 cemented into the inside of container 21 about $\frac{2}{3}$ of the height of cylinder 21 from the bottom to form an upper fan chamber 23 and a lower electrical chamber 24. Motor 13 may be cemented into an opening in platform 22. Blade 15 may be soldered to the drive gear at the end of the motor shaft.

In making the invention it is convenient to first remove the top and bottom of a beverage can, assemble the internal components and then snap-fasten plastic bottom 25 and plastic top 26 to container 21. Before adding top 26, it is convenient to fasten bowl 16 having a screen 30 near the bottom by force-fitting it on hollow grommet 27 and separated from top 26 by fiber washers 31. Grommet 27 and screen 30 are typically brass.

Stem 12 is typically an alligator clip insulating boot made of flexible vinyl material seated in an opening as shown at substantially the same height as blade 15.

Switch 11 may be fastened below stem 12 as shown in a conventional manner through an opening in the wall of cylindrical container 21 with a hex nut. Battery 14 may be lodged in a conventional battery holder in the lower electrical chamber 24 and comprise two 1.5 v. penlite cells in series.

One lead 32 is directly connected from conventional battery connector 33 to motor 13, typically a conventional 3–12 volt DC toy motor. The other lead 34 is connected through switch 11. Tops 25 and 26 are preferably clamp fitted as shown to facilitate having access to both chambers for battery replacement, cleaning or making other repairs. A feature of the invention is that polarity is unimportant because the direction of rotation of blade 15 makes no difference in operation. A low pressure region is created near the axis as blade 15 rotates to draw smoke into fan chamber 23 through the opening at the bottom of bowl 16 while creating a higher pressure region far from the axis that forces the smoke through stem 12 in a dense stream. The fan chamber also functions to cool the smoke. The metal of the container helps to conduct heat from the fan chamber.

The invention works well, and the following structural limitations are believed to be important for preferred operation. The axis of bowl 16, fan 15 and motor 13 should preferably be coextensive with the axis 35 of cylindrical container 21. The radial span of blade 15 should be greater than its axial span and preferably greater than the inside radius of cylindrical container 21. Its height is preferably greater than the diameter of stem 12 at the end inside fan chamber 23.

There has been described novel apparatus and techniques for economically providing automatic pipe smoking that provides good draw on the pipe bowl and ejects a dense stream of cooled smoke. It is evident that those skilled in the art may now make numerous uses and modifications of and departures from the specific embodiments described herein without departing from the inventive concepts. Consequently, the invention is to be construed as embracing each and every novel feature and novel combination of features present in or possessed by the apparatus and techniques disclosed herein and limited solely by the spirit and scope of the appended claims.

What is claimed is:

1. Automatic smoking apparatus comprising, means defining a generally circularly cylindrical container divided into an upper fan chamber for accommodating a fan and an electrical chamber for accommodating an electrical drive motor, bowl means for accommodating smoking material supported above said fan chamber with means defining a passage for communicating between said bowl means and said fan chamber, stem means for carrying smoke ejected from said fan chamber having an opening communicating with said fan chamber, an electric motor in said electrical chamber having a spindle, a flat fan blade having its length perpendicular to the container axis of said cylindrical container being greater than its height along said container axis, means for connecting said fan blade to the electric motor spindle, and means for selectively providing electrical energy to said electrical motor to rotate said fan blade, the axis of rotation of said fan blade, the axis of said spindle and the axis of said bowl means coinciding, the stem axis of said stem means coincident with a diameter of said container embraced by said blade so that rotation of said blade produces a decrease in pressure in said fan chamber along said container axis for drawing smoke from said bowl means into said fan chamber and an increase in pressure adjacent the opening of said stem means for ejecting smoke from said fan chamber through said stem means.

2. Automatic smoking apparatus in accordance with claim 1 wherein the length dimension of said fan blade is greater than the radius of said cylindrical container.

3. Automatic smoking apparatus in accordance with claim 2 wherein the axial dimension of said fan blade is slightly greater than the dimension across said stem opening.

4. Automatic smoking apparatus in accordance with claim 3 and further comprising a circular platform secured to the inside wall of said cylindrical casing separating said fan chamber from said electrical chamber and formed with an opening for accommodating said electric motor, the axis of said electric motor coinciding with said container axis.

5. Automatic smoking apparatus in accordance with claim 4 and further comprising, a battery inside said electrical chamber and wherein said means for selectively applying electrical energy comprises a switch below said stem means secured to the wall of said cylindrical casing for selectively connecting current from said battery means to said electric motor.

6. Automatic smoking apparatus comprising, means defining a generally circularly cylindrical container divided into an upper fan chamber for accommodating a fan and an electrical chamber for accommodating an electrical drive motor, bowl means for accommodating smoking material supported above said fan chamber with means defining a passage for communicating between said bowl means and said fan chamber, stem means for carrying smoke ejected from said fan chamber having an opening communicating with said fan chamber, an electric motor in said electrical chamber having a spindle, a flat fan blade having its length perpendicular to the container axis of said cylindrical container being greater than its height along said container axis, means for connecting said fan blade to the electric motor spindle, and means for selectively providing electrical energy to said electrical motor to rotate said fan blade, the axis of rotation of said fan blade and said bowl means coinciding, the stem axis of said stem means coincident with a diameter of said container embraced by said blade so that rotation of said blade produces a decrease in pressure in said fan chamber along said container axis for drawing smoke from said bowl means into said fan chamber and an increase in pressure adjacent the opening of said stem means for ejecting smoke from said fan chamber through said stem means, the length dimension of said fan blade being greater than the radius of said cylindrical container, the axial dimension of said fan blade being slightly greater than the dimension across said stem opening.

7. Automatic smoking apparatus in accordance with claim 6 and further comprising a circular platform secured to the inside wall of said cylindrical casing separating said fan chamber from said electrical chamber and formed with an opening for accommodating said electric motor, the axis of said electric motor coinciding with said container axis.

8. Automatic smoking apparatus in accordance with claim 7 and further comprising, a battery inside said electrical chamber and wherein said means for selectively applying electrical energy comprises a switch below said stem means secured to the wall of said cylindrical casing for selectively connecting current from said battery means to said electric motor.

* * * * *